US007163592B2

(12) United States Patent
Matsuoka et al.

(10) Patent No.: US 7,163,592 B2
(45) Date of Patent: Jan. 16, 2007

(54) STEEL SHEET FOR TENSION MASK, MANUFACTURING METHOD OF STEEL SHEET FOR TENSION MASK, TENSION MASK AND CATHODE RAY TUBE

(75) Inventors: Hideki Matsuoka, Tokyo (JP); Yasushi Tanaka, Tokyo (JP); Reiko Sugihara, Tokyo (JP); Tatsuhiko Hiratani, Tokyo (JP); Kenichiro Takayanagi, Tokyo (JP); Masamichi Okada, Tokyo (JP); Hiroaki Kato, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 353 days.

(21) Appl. No.: 10/613,555

(22) Filed: Jul. 2, 2003

(65) Prior Publication Data

US 2004/0003868 A1 Jan. 8, 2004

Related U.S. Application Data

(63) Continuation of application No. PCT/JP02/01944, filed on Mar. 4, 2002.

(30) Foreign Application Priority Data

Mar. 5, 2001 (JP) ..... 2001-059917

(51) Int. Cl.
*H01F 1/147* (2006.01)
*H01F 1/16* (2006.01)

(52) U.S. Cl. ..... 148/306; 148/120

(58) Field of Classification Search ..... None
See application file for complete search history.

(56) References Cited

U.S. PATENT DOCUMENTS 6,566,796 B1 * 5/2003 Kodama et al. ..... 313/402
6,635,361 B1 10/2003 Sugihara et al.
2002/0011282 A1 * 1/2002 Hiratani et al. ..... 148/306

FOREIGN PATENT DOCUMENTS

| | | | |
|---|---|---|---|
| EP | 1 126 041 | A1 | 8/2001 |
| EP | 1 134 297 | A1 * | 9/2001 |
| EP | 1 170 388 | A | 1/2002 |
| GB | 2 234 140 | A | 8/1999 |
| JP | 61-190041 | A | 8/1986 |
| JP | 62-249339 | A | 10/1987 |
| JP | 63-145744 | A | 6/1988 |
| JP | 5-311327 | A | 11/1993 |
| JP | 5-311330 | A | 11/1993 |
| JP | 5-311331 | A | 11/1993 |
| JP | 5-311332 | A | 11/1993 |
| JP | 6-73503 | A | 3/1994 |
| JP | 8-27541 | A | 1/1996 |
| JP | 8-269569 | A | 10/1996 |
| JP | 9-227998 | A | 9/1997 |
| JP | 9-256061 | A | 9/1997 |

(Continued)

*Primary Examiner*—John P. Sheehan
(74) *Attorney, Agent, or Firm*—Frishauf, Holtz, Goodman & Chick, P.C.

(57) ABSTRACT

A steel sheet for a tension mask excellent in the shielding properties from geomagnetism consists essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N and the balance of Fe, and has an anhysteretic magnetic permeability of 5,000 or higher.

12 Claims, 1 Drawing Sheet

FOREIGN PATENT DOCUMENTS

| | | | |
|---|---|---|---|
| JP | 9-296255 | A | 11/1997 |
| JP | 10-219396 | A | 8/1998 |
| JP | 10-219401 | A | 8/1998 |
| JP | 11-222628 | A | 8/1999 |
| WO | WO 01/12870 | A1 | 2/2001 |

* cited by examiner

STEEL SHEET FOR TENSION MASK, MANUFACTURING METHOD OF STEEL SHEET FOR TENSION MASK, TENSION MASK AND CATHODE RAY TUBE

This application is a continuation application of International Application PCT/JP02/01944 filed Mar. 4, 2002.

TECHNICAL FIELD

The present invention relates to a steel sheet for a tension mask used in a tension type color selecting electrode for a cathode ray tube such as a color television receiver or a color display for a computer, a method of manufacturing the particular steel sheet, a tension mask and a cathode ray tube each using the particular steel sheet as well as a method capable of improving a magnetic properties of a steel sheet for a tension mask.

BACKGROUND ART

A tension type color selecting electrode (hereinafter referred to as a tension mask) such as an aperture grill is used as a color selecting mechanism in a cathode ray tube such as a color television receiver or a color display. The tension mask is prepared by, for example, subjecting a low carbon or ultra low carbon aluminum killed steel to a hot rolling, a cold rolling, a continuous annealing, a secondary cold rolling and, as required, an annealing for removing the residual stress from the steel sheet, followed by perforating the steel sheet by photo etching method, attaching to a frame by loading tension of, for example, 200 to 400 N/mm$^2$ in a single direction or two directions, and applying a blackening treatment to the steel sheet and the frame. The blackening treatment, in which the tension mask is heated to, for example, 450° C. to 500° C. for forming an oxide film of magnetite on the surface, is intended to prevent the rusting and to lower the heat radiation. If the tension of the tension mask is lowered by the creep during the heat treatment, it is possible for various inconveniences to take place. For example, the positions of the holes of the mask are deviated. Also, resonance tends to be caused by the sound from the speaker. Further, it is possible for the electron beams to fail to strike on predetermined positions on a phosphor screen so as to bring about "the color deviation".

The prior arts intended to improve the creep resistance under high temperatures are disclosed in, for example, JP 62-249339 A, JP 5-311327 A, JP 5-311330 A, JP 5-311331 A, JP 5-311332 A, JP 6-73503 A, JP 8-27541 A, JP 9-296255 A, and JP 11-222628 A. These prior arts teach the idea of suppressing the climbing motion of dislocation by adding Mn, Cr, Mo, etc. as steel components and/or adding a large amount of N as a solid solution element.

In recent years, the television receiver and the computer display have been made larger in size, higher in precision and higher in flatness. In this connection, the deviation in the orbits of the electron beams caused by the external magnetic field such as the magnetic field generated by, for example, the geomagnetism has come to attract attentions as the cause of "the color deviation" in addition to "the color deviation" caused by the creep of the tension mask referred to above. It is of course important to improve the deviation in the orbits of the electron beams noted above for improving the color deviation.

The measures for improving "the color deviation" caused by the deviation in the orbits of the electron beams, i.e., the measures for improving the magnetic shielding properties, are also proposed in various publications. For example, the idea of adding Si to the steel sheet is proposed in JP 63-145744 A, JP 8-269569 A and JP 9-256061 A. The idea of adding Cu to the steel sheet is proposed in JP 10-219396 A. Further, the idea of adding Ni to the steel sheet is proposed in JP 10-219401 A.

However, attentions are not paid to the improvement in the magnetic shielding properties in the techniques proposed in JP 62-249339 A, JP 5-311327 A, JP 5-311330 A, JP 5-311331 A, JP 5-311332 A, JP 6-73503 A, JP 8-27541 A, JP 9-296255 A, and JP 11-222628 A.

On the other hand, the magnetic properties can be certainly improved in the techniques proposed in JP 63-145744 A, JP 8-269569 A, JP 9-256061 A, and JP 10-219396 A. In these techniques, however, the surface defect tends to be generated in the hot rolling process and the recrystallization annealing process of the steel sheet because Si or Cu is added to the steel sheet, making it impossible to apply these techniques to the steel sheet for the tension mask requiring severe surface properties.

Further, the technique proposed in JP 10-219401 A is not desirable because the manufacturing cost is increased by the Ni addition and, in addition, the etching properties of the steel sheet are deteriorated.

As described above, the steel sheet exhibiting excellent magnetic shielding properties with satisfying other properties such as the surface properties and the etching properties have not yet been developed in the prior art. Particularly, it is impossible to obtain nowadays the steel sheet exhibiting both the excellent magnetic shielding properties and the excellent creep resistance under high temperatures.

DISCLOSURE OF THE INVENTION

An object of the present invention is to provide a steel sheet for a tension mask exhibiting excellent magnetic shielding properties without deteriorating other properties such as the surface properties and the etching properties and to provided a method of manufacturing the particular steel sheet.

Another object of the present invention is to provide a steel sheet for a tension mask exhibiting both the excellent creep resistance under high temperatures and the excellent magnetic shielding properties without deteriorating, for example, the surface properties and the etching properties, and to provide a method of manufacturing the particular steel sheet.

Still another object of the present invention is to provide a tension mask that permits improving the color deviation and a cathode ray tube using the particular tension mask.

Further, still another object of the present invention is to provide a method capable of improving magnetic properties of a steel sheet for a tension mask.

According to an aspect of the present invention, there is provided a steel sheet for a tension mask excellent in the shielding properties from geomagnetism, said steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and having an anhysteretic magnetic permeability of 5,000 or higher. It is desirable for the steel sheet to have an anhysteretic magnetic permeability not lower than 5,200, more desirably not lower than 6,000.

According to another aspect of the present invention, there is provided a method of manufacturing a steel sheet for a tension mask excellent in the shielding properties from geomagnetism, comprising the steps of obtaining a steel piece consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe; hot rolling the steel piece; cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability. It is desirable for the annealing step to be carried out under a temperature range between the temperature not higher than the recrystallization temperature and the temperature not lower than 510° C., more desirably under a temperature range between the temperature not higher than the recrystallization temperature and the temperature not lower than 560° C.

According to a still another aspect of the present invention, there is provided a steel sheet for a tension mask excellent in both the shielding properties from geomagnetism and the creep resistance under high temperatures, said steel sheet consisting essentially of lower than 0.1% by weight of C, lower than 0.2% by weight of Si, higher than 0.6% and not higher than 2% of by weight Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher. It is desirable for the steel sheet to have an anhysteretic magnetic permeability of 5,200 or higher, more desirably 6,000 or higher.

According to further aspect of the present invention, there is provided a method of manufacturing a steel sheet for a tension mask excellent in both the shielding properties from geomagnetism and the creep resistance under high temperatures, comprising the steps of obtaining a steel piece consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe; hot rolling the steel piece; cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability. It is desirable for the annealing step to be carried out under a temperature range between the temperature not higher than the recrystallization temperature and the temperature not lower than 510° C., more desirably under a temperature range between the temperature not higher than the recrystallization temperature and the temperature not lower than 560° C.

According to a still further aspect of the present invention, there is provided a steel sheet for a tension mask excellent in the shielding properties from geomagnetism, said steel sheet being manufactured by the method comprising the steps of obtaining a steel piece consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe; hot rolling the steel piece; cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability.

According to a still further aspect of the present invention, there is provided a steel sheet for a tension mask excellent in both the shielding properties from geomagnetism and the creep resistance under high temperatures, said steel sheet being manufactured by the method comprising the steps of obtaining a steel piece consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe; hot rolling the steel piece; cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability.

According to a still further aspect of the present invention, there is provided a tension mask formed of a steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and having an anhysteretic magnetic permeability of 5,000 or higher.

According to a still further aspect of the present invention, there is provided a tension mask formed of a steel sheet consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher.

According to a still further aspect of the present invention, there is provided a cathode ray tube comprising a tension mask formed of a steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance Fe, and having an anhysteretic magnetic permeability of 5,000 or higher.

Further, according to a still further aspect of the present invention, there is provided a cathode ray tube comprising a tension mask formed of a steel sheet consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher.

Further, according to a still further aspect of the present invention, there is provided a method capable of improving a magnetic properties of a steel sheet for a tension mask, comprising the steps of preparing a cold-rolled steel sheet and annealing the cold-rolled steel sheet under a temperature region not higher than the recrystallization temperature so as to increase the anhysteretic magnetic permeability.

BEST MODE OF WORKING THE INVENTION

Figure 1:
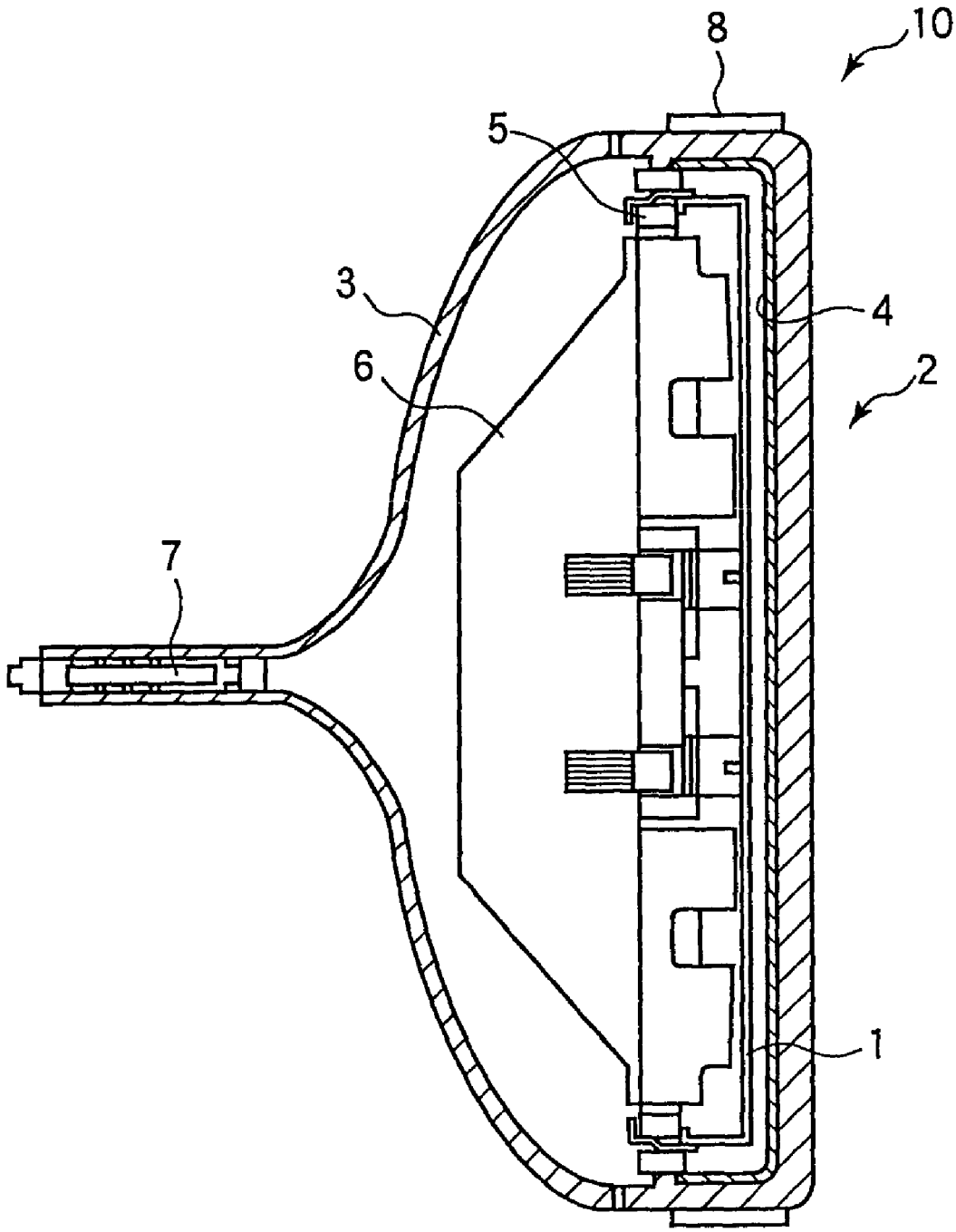
FIG. 1 is a cross sectional view showing a cathode ray tube equipped with a tension mask

The present invention will now be described in detail.

In general, the magnetic shielding properties are evaluated by the magnetic permeability of the material. The magnetic permeability can be improved by decreasing the contents of Mn, Mo, Cr, N, etc. in the steel sheet. If the contents of these elements are decreased, however, the creep resistance of the steel sheet under high temperatures is deteriorated. In other words, the improvement in the magnetic permeability tends to be contradictory to the improvement in the creep resistance under high temperatures. Such being the situation, the present inventors have conducted again a research on the factors actually contributing to the magnetic shielding properties of a cathode ray tube.

A television receiver or a color display includes a mechanism of allowing an electric current to flow through a demagnetizing coil when, for example, the power supply is turned on so as to demagnetize the materials within the cathode ray tube. However, the demagnetization is carried out in an external magnetic field such as the geomagnetic field, with the result that the tension mask is not completely demagnetized such that a residual magnetization is generated inside the tension mask. The value obtained by dividing the residual magnetization by the external magnetic field is called the anhysteretic magnetic permeability. The external magnetic field such as the magnetic flux of the geomagnetism tends to run easily into the tension mask with increase in the anhysteretic magnetic permeability of the tension mask so as to improve the magnetic shielding properties between the electron gun and the tension mask.

Under the circumstances, the present inventors have conducted an extensive research on the relationship between a steel sheet suitable for forming a tension mask and the generation of the color deviation so as to arrive at a method of manufacturing a steel sheet for a tension mask excellent in both the creep resistance under high temperatures and the magnetic shielding properties and a tension mask excellent in both the creep resistance under high temperatures and the magnetic shielding properties, which is manufactured by the particular method, as disclosed in Japanese Patent Application No. 11-360697 filed previously. To be more specific, the present inventors developed previously a method of manufacturing a steel sheet for a tension mask excellent in both the creep resistance under high temperatures and the magnetic shielding properties, comprising the steps of hot rolling a steel sheet consisting essentially of lower than 0.1% by weight of C, not higher than 0.05% by weight of Si, 0.4 to 2% by weight of Mn, not higher than 0.03% by weight of P, not higher than 0.03% by weight of S, not higher than 0.01% by weight of sol. Al, not lower than 0.010% by weight of N and the balance of Fe; cold rolling the resultant hot-rolled steel sheet; annealing the cold-rolled steel sheet; and applying a secondary cold rolling to the resultant steel sheet under a rolling reduction not lower than 35%, also developed a steel sheet for a tension mask excellent in both the creep resistance under high temperatures and the magnetic shielding properties and having at least 3,400 of an anhysteretic magnetic permeability under a DC bias magnetic field of 27.9 A/m (0.35 Oe).

The present inventors have conducted a further research so as to find:

i) If the steel sheet after the final cold rolling is annealed under temperatures not higher than the recrystallization temperature, it is possible to improve the anhysteretic magnetic permeability of the steel sheet after the blackening treatment under the DC bias magnetic field of 27.9 A/m (0.35 Oe);

ii) In order to further improve the anhysteretic magnetic permeability of the steel sheet after the blackening treatment under the DC bias magnetic field of 27.9 A/m (0.35 Oe), it is desirable to set the N content of the steel sheet at a level lower than 0.01% by weight;

iii) If the N content of the steel sheet is set lower than 0.01% by weight, the creep resistance of the steel sheet under high temperatures tends to be rendered lower than that in the case where the N content noted above is not lower than 0.01% by weight. However, if the N content of the steel sheet is set at a level not lower than 0.006% by weight and, at the same time, if the Mn content of the steel sheet is set higher than 0.6% by weight, it is possible to obtain a satisfactory creep resistance of the steel sheet under high temperatures without deteriorating the magnetic shielding properties; and iv) If the steel sheet having the compositions set as pointed out in item iii) described above is annealed under a temperature region not higher than the recrystallization temperature, it is possible to obtain a satisfactory creep resistance under high temperatures and, at the same time, excellent magnetic shielding properties.

The present invention has been arrived at on the basis of the findings pointed out above.

The mode of working the present invention will now be described.

The steel sheet for a tension mask according to a first embodiment of the present invention consists essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and has an anhysteretic magnetic permeability of 5,000 or higher. The particular steel sheet for a tension mask exhibits excellent magnetic shielding properties without deteriorating other properties such as the surface properties and the etching properties.

The reasons for the contents of the components of the steel sheet noted above are as follows:

C: C is effective for improving the creep resistance of the steel sheet under high temperatures. However, if C is added in an amount not smaller than 0.1% by weight, a coarse cementite is precipitated in the steel sheet so as to deteriorate the etching properties of the steel sheet. It follows that the C content should be lower than 0.1% by weight. Preferably, the C content should be not higher than 0.06% by weight, more preferably not higher than 0.03% by weight.

Si: Si forms a nonmetallic inclusion so as to deteriorate the etching properties of the steel sheet and, thus, should be added in an amount smaller than 0.2% by weight. It is more desirable for the Si content to be not higher than 0.05% by weight, furthermore desirably not higher than 0.03% by weight.

Mn: Mn serves together with N to improve the creep resistance of the steel sheet under high temperatures. Particular effect can be produced in the case where the Mn content is not lower than 0.4% by weight. However, if the Mn content exceeds 2% by weight, the particular effect produced by the Mn addition is saturated. In other words, the Mn addition exceeding 2% by weight causes an increase in the manufacturing cost of the steel sheet. In addition, a central segregation is brought about by the excessive Mn addition so as to cause a defective etching of the steel sheet. Under the circumstances, it is desirable for the Mn content of the steel sheet to fall within a range of between 0.4% and 2% by weight, preferably between 0.4% and 1.4% by weight.

P: P contributes to improvement in the mechanical strength of the steel sheet. However, P tends to bring about a nonuniform etching derived from the segregation. Therefore, it is desirable for the P content to be not higher than 0.1% by weight, desirably not higher than 0.03% by weight in view of the effect of further suppressing the nonuniform etching. It is furthermore desirable for the P content to be not higher than 0.02% by weight.

S: S is unavoidably contained in the steel. Where S is contained in the steel sheet in an amount exceeding 0.03% by weight, a hot shortness is caused in the steel sheet and, at the same time, a nonuniform etching derived from the S segregation is generated. It follows that the S content should desirably be not higher than 0.03% by weight, more desirably not higher than 0.02% by weight.

N: If N is contained in the steel sheet in an amount exceeding 0.02% by weight, the magnetic properties of the steel sheet are markedly deteriorated. On the other hand, if N is contained as a solid solution element, the creep resistance of the steel sheet under high temperatures can be improved. However, if the N content of the steel sheet is lower than 0.003% by weight, the particular effect cannot be produced. Such being the situation, the N content should be 0.003 to 0.02% by weight. Also, if the N content is lower than 0.01% by weight, the steel sheet is allowed to exhibit excellent magnetic properties. It follows that it is more desirable for the N content to be not lower than 0.003% by weight and lower than 0.01% by weight.

Sol. Al: Sol. Al serves to fix solute N in the steel as AlN. Therefore, if sol. Al is contained in a large amount, the amount of the solute N, which produces the effect of improving the creep resistance of the steel sheet under high temperatures, is decreased. It follows that it is desirable for the amount of sol. Al to be as small as possible. Such being the situation, the sol. Al content is specified in the present invention to be not higher than 0.01% by weight.

It is also possible to add as required Cr, Mo, W, etc., which are known to improve the creep resistance of the steel sheet under high temperatures. In this case, it is desirable to set the sum of these additional elements at 1% by weight or less in view of the etching properties and the magnetic properties of the steel sheet.

In the present invention, the steel sheet is defined to have an anhysteretic magnetic permeability of 5,000 or higher. The steel sheet having an anhysteretic magnetic permeability of 5,000 or higher produces satisfactory magnetic shielding properties. In order to obtain more satisfactory magnetic shielding properties, it is desirable for the steel sheet to have an anhysteretic magnetic permeability of 5,200 or higher, more desirably 6,000 or higher. If the steel sheet is annealed under a temperature not higher than the anhysteretic magnetic permeability after the cold rolling, it is possible for the steel sheet to have the anhysteretic magnetic permeability of 5,000 or higher as described later. In addition, if the impurity level in the steel is reduced, it is possible for the steel sheet to have the anhysteretic magnetic permeability of 6,000 or higher.

The steel sheet for a tension mask according to a second embodiment of the present invention consists essentially of lower than 0.1% by weight of C, lower than 0.2% by weight of Si, higher than 0.6% and not higher than 2% of by weight Mn, not higher than 0.1% by weight of P, not higher than 0.03% by weight of S, not higher than 0.01% by weight of sol. Al, not lower than 0.006% and lower than 0.01% by weight of N, and the balance of Fe, and has an anhysteretic magnetic permeability of 5,000 or higher. The steel sheet meeting the conditions given above exhibits both the excellent magnetic shielding properties and the excellent creep resistance under high temperatures.

The reasons for the definition of the contents of the components of the steel sheet given above are as follows:

Si: Si deteriorates the etching properties of the steel sheet as described previously in conjunction with the first embodiment of the present invention. Therefore, the Si content of the steel sheet should be lower than 0.2% by weight, desirably not higher than 0.05% by weight, and more desirably not higher than 0.03% by weight.

N: As described previously in conjunction with the first embodiment of the present invention, the steel sheet having the N content lower than 0.01% by weight permits producing excellent magnetic properties. Also, as described previously, the solute N in the steel permits improving the creep resistance of the steel sheet under high temperatures. More prominent creep resistance under high temperatures can be obtained if the N content is not lower than 0.006% by weight. Further, the steel sheet is allowed to exhibit both the excellent magnetic shielding properties and the excellent creep resistance under high temperatures, if the N content and the Mn content, which will be referred to herein later, are set such that the N content is not lower than 0.006% by weight and lower than 0.01% by weight and the Mn content is higher than 0.6% by weight and not higher than 2% by weight. Such being the situation, the N content should be not lower than 0.006% by weight and lower than 0.01% by weight in the second embodiment of the present invention. In view of the balance between the creep resistance under high temperatures and the magnetic properties, it is desirable for the N content to be not lower than 0.0070% by weight and lower than 0.0100% by weight, more desirably not lower than 0.0080% by weight and lower than 0.0100% by weight.

Mn: Mn serves together with N to improve the creep resistance of the steel sheet under high temperatures. As described previously, the steel sheet is allowed to exhibit both the excellent creep resistance under high temperatures and the excellent magnetic shielding properties if the N content of the steel sheet is not lower than 0.006% by weight and lower than 0.01% by weight in the case where the Mn content exceeds 0.6% by weight. On the other hand, if the Mn content exceeds 2% by weight, the effect of improving the creep resistance of the steel sheet under high temperatures is saturated. In other words, the Mn content higher than 2% by weight causes an increase in the manufacturing cost of the steel sheet. Also, the addition of an excessive amount of Mn brings about a central segregation, with the result that a defective etching of the steel sheet tends to be caused. Such being the situation, the Mn content should be higher than 0.6% by weight and not higher than 2% by weight, more desirably higher than 0.6% by weight and not higher than 1.4% by weight. It should also be noted that the creep resistance of the steel sheet under high temperatures can be markedly improved if Mn is added in an amount not lower than 0.7% by weight. Therefore, the Mn content of the steel sheet should fall within a range of between 0.7% by weight and 2.0% by weight, more desirably between 0.7% by weight and 1.4% by weight.

Sol. Al: Sol. Al serves to fix solute N in the steel as AlN. Therefore, if sol. Al is contained in a large amount, the amount of the solute N, which produces the effect of improving the creep resistance of the steel sheet under high temperatures, is decreased. It follows that, in order to obtain the steel sheet exhibiting both the excellent magnetic shielding properties and the excellent creep resistance under high temperatures, it is desirable for the amount of sol. Al to be as small as possible. Such being the situation, the sol. Al content is specified in the present invention to be not higher than 0.01% by weight.

Incidentally, the reasons for the definition of the C content, which is lower than 0.1% by weight, the P content, which is not higher than 0.1% by weight, and the S content, which is not higher than 0.03% by weight, are equal to those described previously in conjunction with the first embodiment of the present invention. It is also possible to add as required additional elements such as Cr, Mo and W, which are known to improve the creep resistance of the steel sheet under high temperatures, as in the first embodiment of the present invention. In this case, it is desirable to set the sum of these additional elements at 1% by weight or less. The reason for the definition of the anhysteretic magnetic permeability, which should be not lower than 5,000, is also equal to that described previously in conjunction with the first embodiment.

The method of manufacturing the steel sheet for a tension mask according to each of the first and second embodiments of the present invention will now be described.

The steel having the composition described above is smelted, hot rolled, and pickled, and cold rolled by the known methods so as to obtain a steel sheet having a predetermined thickness. It is possible to apply the cold rolling only once or a plurality of times with an intermediate annealing treatment interposed between the adjacent cold rolling processes. Where the cold rolling is applied a plurality of times with the recrystallization annealing treatment interposed as the intermediate annealing treatment between the adjacent cold rolling processes, it is desirable for the final cold rolling reduction to be at least 25% in order to ensure the mechanical strength of the steel sheet required for use of the steel sheet for forming a tension mask. More desirably, the final cold rolling reduction should be at least 35%, and furthermore desirably at least 40%. On the other hand, an excessive increase in the cold rolling reduction leads to an increase in the cold rolling mill load. Therefore, the upper limit of the cold rolling reduction should desirably be 80%, more desirably 70%. Incidentally, in the case of performing a skin pass rolling described herein later, the cold rolling reduction of the final cold rolling represents the cold rolling reduction of the cold rolling immediately before the skin pass cold rolling.

It is possible to apply a skin pass rolling to the steel sheet after the final cold rolling or to pass the steel sheet after the final cold rolling through a shape-correcting line such as a tension leveler or a roller leveler in order to correct the shape of the steel sheet.

In the next step, an annealing treatment is applied to the steel sheet obtained after the cold rolling or to the steel sheet subjected to the shape-correcting treatment after the cold rolling so as to improve the magnetic properties of the steel sheet. The annealing treatment is carried out under a temperature region in which the recrystallization does not take place. In the prior art, the annealing treatment is carried out after the cold rolling in order to decrease the residual stress within the steel sheet. In the present invention, however, the annealing treatment is carried out after the cold rolling in order to improve the magnetic properties of the steel sheet regardless of the presence or absence of the internal stress. The annealing treatment is carried out under a temperature region not higher than the recrystallization temperature. To be more specific, it is desirable to carry out the annealing treatment under temperatures not lower than 450° C. because it is difficult to obtain the effect of improving the magnetic properties if the annealing treatment is carried out under temperatures lower than 450° C. In order to obtain a greater effect of improving the magnetic properties of the steel sheet, it is more desirable to carry out the annealing treatment under temperatures not lower than 480° C. Particularly, the steel sheet can be allowed to exhibit the anhysteretic magnetic permeability of 5,000 or higher stably if the annealing treatment is carried out under temperatures not lower than 510° C., and the steel sheet can be allowed to exhibit the anhysteretic magnetic permeability of 5,200 or higher if the annealing treatment is carried out under temperatures not lower than 560° C. It follows that it is furthermore desirable to carry out the annealing treatment under temperatures not lower than 510° C., most desirably under temperatures not lower than 560° C. It should be noted, however, that, if the annealing temperature exceeds 600° C., it is possible for the recrystallization to be started within the steel sheet so as to rapidly deteriorate the creep resistance of the steel sheet under high temperatures. It follows that it is desirable for the annealing temperature not to exceed 600° C. Also, in order to ensure the stability in the manufacturing process while preventing the rapid deterioration of the creep resistance under high temperatures, it is desirable to carry out the annealing treatment under temperatures not higher than 590° C., more desirably under temperatures not higher than 580° C.

It is possible to obtain a tension mask by etching the steel sheet for a tension mask according to any of the first and second embodiments of the present invention described above so as to perforate the steel sheet, followed by stretching the perforated steel sheet over a frame and subsequently applying a blackening treatment to the stretched steel sheet. The tension mask thus prepared is unlikely to give rise to the color deviation problem because the raw material steel sheet exhibits excellent magnetic shielding properties without deteriorating other properties or exhibits both the excellent magnetic shielding properties and the excellent creep resistance under high temperatures. It follows that the cathode ray tube using the particular tension mask is of high performance, which is almost free from the color deviation problem.

FIG. 1 is a cross sectional view showing a cathode ray tube 10 equipped with such a tension mask. As shown in the drawing, the cathode ray tube 10 comprises a panel portion 2 for displaying an image and a funnel portion 3. The panel portion 2 is welded to the funnel portion 3. Interior of the cathode ray tube 10 is maintained a high vacuum. A phosphor screen 4 coated with red, green and blue phosphors is arranged inside the panel portion 2, and a tension mask 1 is arranged facing the phosphor screen 4. The tension mask 1 is stretched by a frame 5, and these tension mask 1 and frame 5 collectively constitute a color selecting electrode. An inner magnetic shield 6 is arranged on the back surface of the frame 5. Incidentally, a reference numeral 7 shown in the drawing denotes an electron gun, and a reference numeral 8 denotes a heat shrink band.

EXAMPLE 1

Prepared were steel samples A to J having the compositions shown in Table 1. Each of these steel samples was smelted, hot rolled, pickled and cold rolled. Then, after the recrystallization annealing, a secondary cold rolling with the rolling reduction of 60% was applied to the rolled and annealed steel sheet so as to obtain a steel sheet having a thickness of 0.1 mm. Further, these steel sheets were annealed at 510° C. to 580° C. for 50 seconds so as to obtain steel sheet samples Nos. 2 to 4 and 6 to 15 shown in Table 2. Also obtained were steel sheet samples Nos. 1 and 5, in which an annealing treatment was not applied to the steel sheet after the secondary cold rolling.

TABLE 1

(wt %)

| Steel Samples | C | Si | Mn | P | S | sol. Al | N | Cr |
|---|---|---|---|---|---|---|---|---|
| A | 0.007 | 0.01 | 0.45 | 0.015 | 0.005 | 0.001 | 0.0042 | 0.04 |
| B | 0.008 | 0.02 | 0.46 | 0.012 | 0.006 | 0.005 | 0.0072 | 0.05 |
| C | 0.007 | 0.02 | 0.73 | 0.016 | 0.004 | 0.005 | 0.0090 | 0.05 |
| D | 0.008 | 0.02 | 0.94 | 0.008 | 0.010 | 0.003 | 0.0088 | 0.05 |
| E | 0.007 | 0.02 | 1.10 | 0.007 | 0.003 | 0.008 | 0.0091 | 0.04 |
| F | 0.007 | 0.02 | 1.40 | 0.015 | 0.005 | 0.005 | 0.0085 | 0.04 |
| G | 0.008 | 0.01 | 0.58 | 0.012 | 0.008 | 0.004 | 0.0205 | 0.04 |
| H | 0.018 | 0.01 | 0.90 | 0.005 | 0.007 | 0.008 | 0.0090 | 0.05 |
| I | 0.041 | 0.01 | 0.85 | 0.009 | 0.006 | 0.004 | 0.0096 | 0.04 |
| J | 0.120 | 0.01 | 0.60 | 0.007 | 0.005 | 0.008 | 0.0087 | 0.04 |

The etching properties were evaluated in respect of the steel sheet samples Nos. 1 to 15 thus obtained. Specifically, the steel sheet sample was actually etched in the form of the aperture grill so as to evaluate visually the state of the etching (presence or absence of defect).

Then, the creep resistance of steel sheet samples Nos. 1 to 14 under high temperatures, which were found to be satisfactory in the etching properties, was measured. Further, the magnetic properties of these steel sheet samples except for No. 9 were measured.

The creep resistance under high temperatures was evaluated by measuring the amount of the creep elongation under the state that the steel sheet manufactured as described above was kept heated at 450° C. for 20 minutes with a tension of 300 N/mm$^2$ applied to the steel sheet.

The magnetic properties were measured as follows. An annular test piece having an outer diameter of 45 mm and an inner diameter of 33 mm was taken from the steel sheet sample to which a heat treatment corresponding to the blackening treatment had been applied at 450° C. for 20 minutes. The annular test piece thus prepared was wound with a magnetization coil, a search coil and a DC-bias-field coil so as to measure the anhysteretic magnetic permeability.

The anhysteretic magnetic permeability was measured as follows:

i) An attenuating AC current was allowed to flow through the magnetization coil so as to demagnetize the test piece completely.

ii) An attenuating AC current was allowed to flow again through the magnetization coil under the state that a DC bias magnetic field of 27.9 A/m (0.35 Oe) was generated by allowing a DC current to flow through the DC-bias-field coil, so as to demagnetize the test piece.

iii) A DC current was allowed to flow through the magnetization coil so as to excite the test piece, and the generated magnetic flux was detected by the search coil so as to measure a B-H curve.

iv) The anhysteretic magnetic permeability was calculated from the B-H curve thus prepared.

Table 2 shows the annealing temperatures, the etching properties, the results of evaluation of the creep resistance under high temperatures and the results of measurement of the magnetic properties for the steel sheet samples Nos. 1 to 15:

The basis for the evaluation of etching properties is as follows. The evaluation "○" given in Table 2 denotes that the etching properties was good in the case where a defect was not found visually after the etching. Also, the evaluation "x" in Table 2 denotes that the etching properties was poor in the case where a defect was found after the etching.

The basis for the evaluation of the creep resistance under high temperatures is as follows. The evaluation "◎" given in Table 2 denotes that the creep resistance under high temperatures was excellent in the case where the amount of the creep elongation was not lager than 0.30%, the evaluation "○" denotes that the steel sheet can be used in the case where the amount of the creep elongation exceeds 0.30% and does not exceed 0.50%, and the evaluation "x" denotes that the steel sheet cannot be used in the case where the amount of the creep elongation exceeds 0.50%. The test was performed both in the rolling direction and the transversal direction, and the average value was taken for the evaluation.

TABLE 2

| No. | Steel Samples | Annealing Temperature after Final Cold Rolling (° C.) | Etching Properties | Properties: Creep Resistance under High Temperatures: Creep Elongation (° C.) | Evaluation | Magnetic Properties: Anhysteretic Magnetic Permeability |
|---|---|---|---|---|---|---|
| 1 | A | No Annealing | ○ | 0.85 | x | 4900 |
| 2 | | 550 | ○ | 0.50 | ○ | 5800 |
| 3 | B | 540 | ○ | 0.31 | ○ | 5300 |
| 4 | C | 580 | ○ | 0.17 | ◎ | 5400 |
| 5 | D | No Annealing | ○ | 0.53 | x | 4600 |
| 6 | | 510 | ○ | 0.13 | ◎ | 5100 |
| 7 | | 560 | ○ | 0.13 | ◎ | 5300 |
| 8 | | 580 | ○ | 0.12 | ◎ | 5400 |
| 9 | | 610 | ○ | 0.88 | x | — |
| 10 | E | 540 | ○ | 0.13 | ◎ | 5300 |
| 11 | F | 540 | ○ | 0.12 | ◎ | 5200 |
| 12 | G | 540 | ○ | 0.18 | ◎ | 3300 |
| 13 | H | 570 | ○ | 0.12 | ◎ | 5200 |
| 14 | I | 560 | ○ | 0.11 | ◎ | 5100 |
| 15 | J | 560 | x | — | — | — |

It should be noted that the compositions of the steels used for preparing the steel sheet samples Nos. 2 to 4, 6 to 8, 10, 11, 13 and 14 fell within the range specified in the first embodiment of the present invention. In addition, each of these steel samples was annealed under the temperature not higher than the recrystallization temperature after the final cold rolling. As apparent from Table 2, these steel sheet samples were satisfactory in the etching properties and excellent in the magnetic shielding properties because these steel sheet samples had high anhysteretic magnetic permeability, i.e., not lower than 5,000. Further, these steel sheet samples were satisfactory in the creep resistance under high temperatures, i.e., the amount of the creep elongation was not larger than 0.50%.

Particularly, in steel sheet samples Nos. 4, 6 to 8, 10, 11, 13 and 14 which fell within the rages specified in the second embodiment of the present invention, each of the steel samples used contained Mn in an amount exceeding 0.6% by weight and not larger than 2% by weight and also contained N in an amount not smaller than 0.006% by weight and smaller than 0.01% by weight. As a result, these steel sheet samples exhibited a very small amount of the creep elongation, i.e., not larger than 0.30%, and a high anhysteretic magnetic permeability so as to support both the excellent creep resistance under high temperatures and the excellent shielding properties from geomagnetism.

On the other hand, steel sheet samples Nos. 1 and 5 had the anhysteretic magnetic permeability lower than 5,000 because both of these steel samples were not annealed after the final cold rolling. Steel sheet sample No. 9, in which the annealing temperature was higher than the level specified in the present invention, was found to be inferior in the creep resistance under high temperatures. Further, steel sheet sample No. 12 was low in the anhysteretic magnetic permeability because the steel sample used for preparing the steel sheet sample contained an excessively large amount of N. Steel sheet sample No. 15 was defective in the etching properties because the steel sheet sample J used for preparing the steel sheet sample No. 15 had a high C (carbon) content.

EXAMPLE 2

Prepared were ingots of steel samples K to Q having the compositions shown in Table 3. Each of these steel samples was hot rolled and pickled, cold rolled. Then, after the recrystallization annealing, a secondary cold rolling with the rolling reduction of 60% was applied to the rolled and annealed steel sheet so as to obtain a steel sheet having a thickness of 0.1 mm. Further, these steel sheet was annealed at 510° C. to 580° C. for 50 seconds so as to obtain steel sheet samples Nos. 21, 22, 24 to 27 and 29 to 35 shown in Table 4. Also obtained were steel sheet samples Nos. 23 and 28, in which an annealing treatment was not applied to the steel sheet after the secondary cold rolling. Incidentally, the impurity levels in these steel samples K to Q were lower than that in steel samples A to J of the Example 1.

TABLE 3

(wt %)

| Steel Samples | C | Si | Mn | P | S | sol. Al | N | Cr |
|---|---|---|---|---|---|---|---|---|
| K | 0.007 | 0.01 | 0.46 | 0.006 | 0.003 | 0.001 | 0.0044 | 0.04 |
| L | 0.007 | 0.01 | 0.44 | 0.007 | 0.003 | 0.003 | 0.0070 | 0.03 |
| M | 0.007 | 0.01 | 0.71 | 0.005 | 0.002 | 0.003 | 0.0093 | 0.03 |
| N | 0.007 | 0.01 | 0.92 | 0.004 | 0.010 | 0.006 | 0.0087 | 0.04 |
| O | 0.007 | 0.01 | 1.09 | 0.004 | 0.002 | 0.003 | 0.0090 | 0.04 |
| P | 0.007 | 0.01 | 1.39 | 0.006 | 0.005 | 0.005 | 0.0088 | 0.03 |
| Q | 0.008 | 0.01 | 0.47 | 0.005 | 0.007 | 0.004 | 0.0131 | 0.03 |

The etching properties were evaluated in respect of the steel sheet samples Nos. 21 to 35 thus obtained. The etching properties were evaluated by the same method and basis as described in Example 1. As a result, these steel sheet samples were satisfactory in the etching properties.

The creep resistances of these steel sheet samples Nos. 21 to 35 under high temperatures were evaluated. The magnetic properties of these samples except for No.32 were measured.

The creep resistance under high temperatures was evaluated by the same method and basis as described in Example 1. As for the magnetic properties, the same test pieces as described in Example 1 were prepared so as to measure the anhysteretic magnetic permeability by the same method.

Table 4 shows the annealing temperatures, the etching properties, the results of evaluation of the creep resistance under high temperatures and the results of measurement of the magnetic properties for the steel sheet samples Nos. 21 to 35:

TABLE 4

| No. | Steel Samples | Annealing Temperature after Final Cold Rolling (° C.) | Properties: Etching Properties | Creep Resistance under High Temperatures: Creep Elongation (° C.) | Creep Resistance under High Temperatures: Evaluation | Magnetic Properties: Anhysteretic Magnetic Permeability |
|---|---|---|---|---|---|---|
| 21 | K | 570 | ○ | 0.38 | ○ | 8800 |
| 22 | L | 580 | ○ | 0.31 | ○ | 8200 |
| 23 | M | No Annealing | ○ | 0.41 | ○ | 4900 |
| 24 | | 510 | ○ | 0.16 | ◎ | 6600 |
| 25 | | 550 | ○ | 0.13 | ◎ | 7400 |
| 26 | | 570 | ○ | 0.13 | ◎ | 8100 |
| 27 | | 580 | ○ | 0.12 | ◎ | 8600 |
| 28 | N | No Annealing | ○ | 0.39 | ○ | 4900 |
| 29 | | 510 | ○ | 0.13 | ◎ | 6500 |
| 30 | | 560 | ○ | 0.13 | ◎ | 8000 |
| 31 | | 580 | ○ | 0.12 | ◎ | 8500 |
| 32 | | 610 | ○ | 0.88 | x | — |
| 33 | O | 570 | ○ | 0.13 | ◎ | 7800 |
| 34 | P | 580 | ○ | 0.12 | ◎ | 7700 |
| 35 | Q | 580 | ○ | 0.16 | ◎ | 6800 |

It should be noted that the compositions of the steels used for preparing the steel sheet samples Nos. 21, 22, 24 to 27, 29 to 31, 33 and 34 fell within the range specified in the first embodiment of the present invention. In addition, each of these steel sheet samples was annealed under the temperature not higher than the recrystallization temperature after the final cold rolling. As apparent from Table 4, these steel sheet samples were satisfactory in the etching properties and excellent in the magnetic shielding properties because these steel sheet samples had high anhysteretic magnetic permeability. Further, these steel sheet samples were satisfactory comparatively in the creep resistance under high temperatures, i.e., the amount of the creep elongation was not larger than 0.50%. The anhysteretic magnetic permeability of these steel sheet samples Nos. 21, 22, 24 to 27, 29 to 31 and 33 to 35 were higher than that of the Example 1, i.e., not lower than 6,000.

Particularly, in steel sheet samples Nos. 24 to 27, 29 to 31 and 33 to 35 which fell within the ranges specified in the second embodiment of the present invention, each of the steel samples used contained Mn in an amount exceeding 0.6% by weight and not larger than 2% by weight and also contained N in an amount not smaller than 0.006% by weight and smaller than 0.01% by weight. As a result, these steel sheet samples exhibited a very small amount of the creep elongation, i.e., not larger than 0.30%, and a high anhysteretic magnetic permeability so as to support both the excellent creep resistance under high temperatures and the excellent shielding properties from geomagnetism.

On the other hand, steel sheet samples Nos. 23 and 28 had the anhysteretic magnetic permeability lower than 5,000 because both of these steel sheet samples were not annealed after the final cold rolling. Steel sheet sample No. 32, in which the annealing temperature was higher than the level specified in the present invention, was found to be inferior in the creep resistance under high temperatures.

As described above, the present invention makes it possible to obtain a steel sheet for a tension mask that exhibits excellent magnetic shielding properties without deteriorating other properties such as the surface properties and the etching properties, and also makes it possible to obtain a steel sheet for a tension mask exhibiting both the excellent magnetic shielding properties and the excellent creep resistance under high temperatures by controlling the composition of the steel sheet. Further, the present invention makes it possible to obtain a tension mask with improvements in, for example, the color deviation at a low manufacturing cost and a cathode ray tube comprising the particular tension mask.

The invention claimed is:

1. A steel sheet for a tension mask exhibiting excellent geomagnetic shielding properties, said steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and having an anhysteretic magnetic permeability of 5,000 or higher, said steel sheet having a creep elongation of 0.50% or smaller, measured when said steel is maintained at a temperature of 450° C. for 20 minutes with a tension of 300 N/mm$^2$ being applied to said steel sheet.

2. The steel sheet for a tension mask according to claim 1, wherein said anhysteretic magnetic permeability is 5,200 or higher.

3. The steel sheet for a tension mask according to claim 1, wherein said anhysteretic magnetic permeability is 6,000 or higher.

4. A steel sheet for a tension mask exhibiting excellent geomagnetic shielding properties and sheet consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher, said steel sheet having a creep elongation of 0.50% or smaller, measured when said steel is maintained at a temperature of 450° C. for 20 minutes with a tension of 300 N/mm$^2$ being applied to said steel sheet.

5. The steel sheet for a tension mask according to claim 4, wherein said anhysteretic magnetic permeability is 5,200 or higher.

6. The steel sheet for a tension mask according to claim 4, wherein said anhysteretic magnetic permeability is 6,000 or higher.

7. A steel sheet for a tension mask exhibiting excellent geomagnetic shielding properties, said steel sheet being manufactured by the method comprising the steps of:

obtaining a steel piece consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe;

hot rolling said steel piece;

cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability, said steel sheet having a creep elongation of 0.50% or smaller, measured when said steel is maintained at a temperature of 450° C. for 20 minutes with a tension of 300 N/mm$^2$ being applied to said steel sheet.

8. A steel sheet for a tension mask exhibiting excellent geomagnetic shielding properties and excellent creep resistance under high temperatures, said steel sheet being manufactured by the method comprising the steps of:

obtaining a steel piece consisting essentially of lower than 0.1% by weight of C, lower than 0.2% by weight of Si, higher than 0.64 and not higher than 2% by weight of Mn, not higher than 0.1% by weight of P. not higher than 0.03% by weight of S, not higher than 0.01% by weight of sol. Al, not lower than 0.006% and lower than 0.01% by weight of N, and the balance of Fe;

hot rolling said steel piece;

cold rolling once or a plurality of times the hot-rolled steel sheet with or without an intermediate annealing treatment interposed between the adjacent cold rolling processes so as to prepare a steel sheet having a predetermined thickness; and annealing the resultant steel sheet under a temperature region not higher than the recrystallization temperature so as to increase the anhysteretic magnetic permeability, said steel sheet having a creep elongation of 0.50% or smaller, measured when said steel is maintained at a temperature of 450° C. for 20 minutes with a tension of 300 N/mm$^2$ being applied to said steel sheet.

9. In a tension mask formed of a steel sheet, the improvement comprising the steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and having an anhysteretic magnetic permeability of 5,000 or higher. said steel sheet having a creep elongation of 0.50% or smaller, measured when said steel is maintained at a temperature of 450° C for 20 minutes with a tension of 300 N/mm$^2$ being applied to said steel sheet.

10. In a tension mask formed of a steel sheet, the improvement comprising the steel sheet consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher, said steel sheet having a creep elongation of 0.50% or smaller, measured when said steel is maintained at a temperature of 450° C. for 20 minutes with a tension of 300 N $mm^2$ being applied to said steel sheet.

11. A cathode ray tube comprising a tension mask formed of a steel sheet consisting essentially of lower than 0.1% by weight of C, lower than 0.2% by weight of Si, 0.4 to 2% by weight of Mn, not higher than 0.1% by weight of P, not higher than 0.03% by weight of S, not higher than 0.01% by weight of sol. Al, 0.003 to 0.02% by weight of N, and the balance of Fe, and having an anhysteretic magnetic permeability of 5,000 or higher, said steel sheet having a creep elongation of 0.50% or smaller, measured when said steel is maintained at a temperature of 450° C for 20 minutes with a tension of 300 $N/mm^2$ being applied to said steel sheet.

12. A cathode ray tube comprising a tension mask formed of a steel sheet consisting essentially of lower than 0.1% by weight of C, lower than 0.2% by weight of Si, higher than 0.6% and not higher than 2% by weight of Mn, not higher than 0.1% by weight of P, not higher than 0.03% by weight of S, not higher than 0.01% by weight of sol. Al, not lower than 0.006% and lower than 0.01% by weight of N, and the balance of Fe, and having an anhysteretic magnetic permeability of 5,000 or higher, said steel sheet having a creep elongation of 0.50% or smaller, measured when said steel is maintained at a temperature of 450° C for 20 minutes with a tension of 300 $N/mm^2$ being applied to said steel sheet.

* * * * *